United States Patent [19]

Dworak et al.

[11] Patent Number: 4,524,732

[45] Date of Patent: Jun. 25, 1985

[54] CYLINDER HEAD OF A PISTON ENGINE

[75] Inventors: Ulf Dworak, Baltmannsweiler; Hans Olapinski, Aichwald; Dieter Fingerle, Hochdorf; Ulrich Krohn, Leonberg, all of Fed. Rep. of Germany; Martti J. A. Hakulinen, Rönninge; Bengt N. J. Palm, Nykvarn, both of Sweden

[73] Assignee: Feldmühle Aktiengesellschaft, Düsseldorf, Fed. Rep. of Germany

[21] Appl. No.: 585,173

[22] Filed: Mar. 1, 1984

[30] Foreign Application Priority Data

Mar. 1, 1983 [DE] Fed. Rep. of Germany ..... 3307114

[51] Int. Cl.[3] ..... F02F 1/24; F02B 77/11

[52] U.S. Cl. ..... 123/193 H; 123/193 CH; 123/669

[58] Field of Search ..... 123/193 R, 193 CH, 193 H, 123/668, 669, 657

[56] References Cited

U.S. PATENT DOCUMENTS

| | | | |
|---|---|---|---|
| 3,911,891 | 10/1975 | Dowell | 123/669 |
| 4,328,772 | 5/1982 | Heydrich et al. | 123/669 |
| 4,398,527 | 8/1983 | Rynbrandt | 123/668 |

FOREIGN PATENT DOCUMENTS

| | | | |
|---|---|---|---|
| 0147036 | 6/1952 | Australia | 123/669 |
| 570238 | 4/1924 | France | 123/668 |
| 2061383 | 5/1981 | United Kingdom | 123/668 |

*Primary Examiner*—Craig R. Feinberg

[57] ABSTRACT

In a cylinder head (1) of a piston engine, a thermal insulation component having openings for the accommodation of valve seats, spark plugs, and injection nozzles consists of a circular aluminum titanate plate (2) which is shrink-fitted into a planar circular ring of zirconium oxide (12) gripped or shrink-fitted in the cylinder head. The circular plate (2) of aluminum titanate forms the greatest part of the cylinder head bottom (9).

12 Claims, 2 Drawing Figures

CYLINDER HEAD OF A PISTON ENGINE

BACKGROUND OF THE INVENTION

The present invention relates to a cylinder head of a piston engine, having a thermal insulation component made by sintering from aluminum titanate, which has openings for valves, spark plugs or injection nozzles.

For the prevention of wall losses, it has previously been proposed in German Offenlegungsschrift No. 2,821,506 to cover the inside surface of a cylinder head with a laminated insulating plate. The laminated insulating plate described consists of the actual insulating layer and a metal backing plate tightly joined thereto. The insulating layer faces the combustion chamber and consists either of vitreous fused silica, or of silicon nitride or silicon carbide, and it is either fused or sintered onto the metal backing plate, or the insulating layer is of laminated construction with an especially porous middle layer which is formed preferably of spheres of the insulating material. In such a cylinder head it is disadvantageous that the usual arrangement of several separate openings for valves, spark plugs and injection nozzles is difficult to achieve, and consequently it is necessary to have only a single opening in the laminated insulating plate. Another disadvantage lies in the complexity of construction, especially in the fact that the actual insulating layer, on account of its low strength, requires a metal backing plate.

German Offenlegungsschrift No. 3,039,718 disclosed a cylinder head in which a refractory body consisting of silicon nitride is inserted into a thermal insulation component consisting of aluminum titanate, and this laminate is shrink-fitted into a metal supporting body, which in some cases is formed by the cylinder head. The refractory body, which forms the bottom of the cylinder head, faces the combustion chamber and protects the thermal insulation component against mechanical stress. The thermal insulation component is in the form of a circular disk having a marginal rim to accommodate the refractory body. Here, again, the disadvantage is the laminated construction of the individual components consisting of different materials, which is necessitated by the low strength of aluminum titanate. Another disadvantage is that the laminate consisting of the thermal insulation component and the refractory body takes up additional space in the cylinder head and thereby interferes with the complex configurations of the coolant passages. Another disadvantage results from the fact that the cylinder head cannot be sealed against the barrel of the cylinder in the area of the aluminum titanate component, so that the sealing is performed on the refractory body whose thermal conductivity is good, with the disadvantage that a heat bridge is formed. Sealing outside of the laminated component of aluminum titanate is not possible, because, for reasons of design, the valve bores must run all the way to the edge of the component. Since aluminum titanate has a low modulus of elasticity, it is necessary to heat the cylinder head to a relatively high temperature in order to shrink-fit the laminate, and this must be considered an additional disadvantage.

It is the object of the present invention to overcome the existing disadvantages and, for the achievement of a satisfactory insulating effect in the cylinder head, to make available a thermal insulation component which can be inserted into the cylinder head, without the formation of heat bridges to the cylinder head or motor block, and which furthermore is of simple construction and low height, so that the formation of coolant passages is not impaired, at least in this critical region adjacent the combustion chamber. Furthermore the thermal insulation component is to have sufficient strength to resist mechanical forces, especially pressures.

It is a further purpose of the invention to provide for a firm seating of the component in the cylinder head, and at the same time to develop a simple method of installing the thermal insulation component. In particular, the invention intends to make it possible for the thermal insulation component to be locked in place without the need for a refractory body on the thermal insulating component to protect it against the pressure forces that occur.

THE INVENTION

To achieve this object, the invention provides a cylinder head of a piston engine, having a thermal insulation component made from aluminum titanate by sintering, which has openings for the accommodation of valve seats, spark plugs or injection nozzles, which is characterized in that the entire bottom surface of the cylinder head facing the combustion chamber is covered by a thermal insulation component which consists of a planar circular ring of zirconium oxide gripped or shrink-fitted in the cylinder head, into which there is shrink-fitted a circular plate of aluminum titanate which forms the greatest part of the cylinder head bottom.

The present invention makes it possible, on account of the high strength of zirconium oxide, for the thermal insulation component consisting of the circular aluminum titanate plate and the zirconium oxide ring to be gripped in the cylinder head, using for the seal between the component and the engine block a cylinder head gasket of steel, which is known in itself. For the assembly of the cylinder head, the thermal insulation component can be fixed in the cylinder head by means of a tight fit or by temporary cementing. Preferred, however, is shrink-fitting, in which case one method of installation consists of chilling the component and fitting it. In a preferred assembly method, however, the entire cylinder head can be heated, and the component is then installed and the cylinder head allowed to cool.

The advantage of the present invention is that the arrangement of a circular plate of aluminum titanate within a circular ring of zirconium oxide permits such a component to be gripped in the cylinder head without danger of the destruction of the low-strength aluminum titanate plate. Another advantage is that the thermal insulation component in accordance with the invention, on account of the low thermal conductivity of zirconium oxide, which is comparable to that of aluminum titanate, makes it possible to make the entire surface of the cylinder head facing the combustion chamber out of insulating material. In contrast to the cylinder head disclosed by German Offenlegungsschrift No. 3,039,718, the present invention avoids the formation of thermal bridges, since the high strength of zirconium oxide makes it possible to seal off the combustion chamber against the circular ring of zirconium oxide. In contrast to German Offenlegungsschrift No. 2,821,506, the advantage of the present invention is that the complex laminated construction of the insulating layer is eliminated, and it is furthermore possible to provide separate openings for valve seats, spark plugs and injection nozzles in the thermal insulation component. The valve seats can be made of steel, but zirconium oxide is the preferred material for valve seats on account of its great resistance to wear.

In a very especially preferred embodiment of the present invention, the circular ring consists of partially stabilized zirconium oxide. The term, "partially stabilized zirconium oxide (PSZ)", as used in connection with the present invention, is to be understood to refer to a zirconium oxide partially stabilized with the oxides of calcium, magnesium and yttrium, in which the cubic phase does not exceed 80% of the weight of the zirconium oxide content. The grain size of the zirconium oxide in the finished, sintered ring, averages 50 microns.

In additional preferred embodiments, the partially stabilized zirconium oxide has a content of the tetragonal modification between 20 and 60% by weight, and a monoclinic content of not more than 6% by weight, while in any case the content of the cubic modification amounts to no more than 80% by weight and the contents of the individual modifications make up the balance of 100%. The flexural strength of the partially stabilized zirconium oxide amounts preferably to at least 400 MPa, and the porosity is less than 3%.

As regards manufacture, an embodiment has proven to be especially suitable in which the circular plate and the circular ring forming the thermal insulation component are planar and have the same thickness.

The outstanding suitability of the cylinder head of the invention, having a circular aluminum titanate plate held in a circular ring of zirconium oxide, is explained as follows: the maximum temperatures develop in the region adjacent the bores, especially in the narrow portion between the bores of the intake and exhaust valves. The outer region of the circular plate, however, is fundamentally less subject to thermal stress on account of its contact with the gasket or with the cooled engine block. By the artifice of making the circular plate of a good insulating material of low linear thermal expansion, namely from aluminum titanate, the tensions thermally induced in the ring are so slight that in no case do they result in the formation of cracks in this zirconium oxide component, although the thermal expansion of zirconium oxide is more than three times as high as that of aluminum titanate.

On account of the low thermal conductivity of zirconium oxide, however, no loss of insulating effect takes place.

The appended drawings will serve for the further explanation of the invention, although the invention is not limited to the embodiments contained therein.

DESCRIPTION OF PREFERRED EMBODIMENTS

Figure 1:
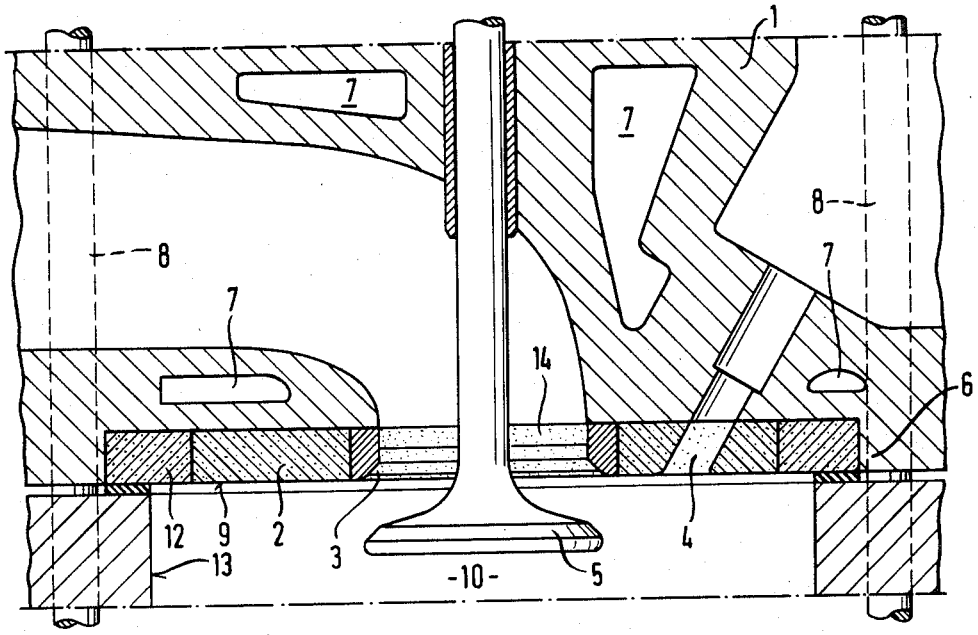
FIG. 1 is a longitudinal cross section through an embodiment of a cylinder head in accordance with the invention, corresponding to line I—I of FIG. 2.

In the cylinder head 1 shown in FIG. 1, the thermal insulation component is a circular plate 2 of aluminum titanate, which is shrink-fitted within a circular ring 12 of partially stabilized zirconium oxide. The component consisting of the circular plate 2 and ring 12 forms the greater part of the cylinder head bottom 9, so that only the rim 6, in which the ring 12 is gripped, is a noninsulating component of the cylinder head bottom 9, but is outside of the combustion chamber 10. A valve seat 3 let into the circular plate 2 consists of partially stabilized zirconium oxide (PSZ).

A bore 4 serves to accommodate an injection nozzle, which is not shown. Coolant passages 7 are formed in the cylinder head 1, and an exhaust valve 5 is shown, plus the cylinder head bolts identified by 8. The sealing of the cylinder head 1 against the combustion chamber 10 is accomplished by a cylinder head gasket 15 between ring 12 and cylinder walls 13.

Figure 2:
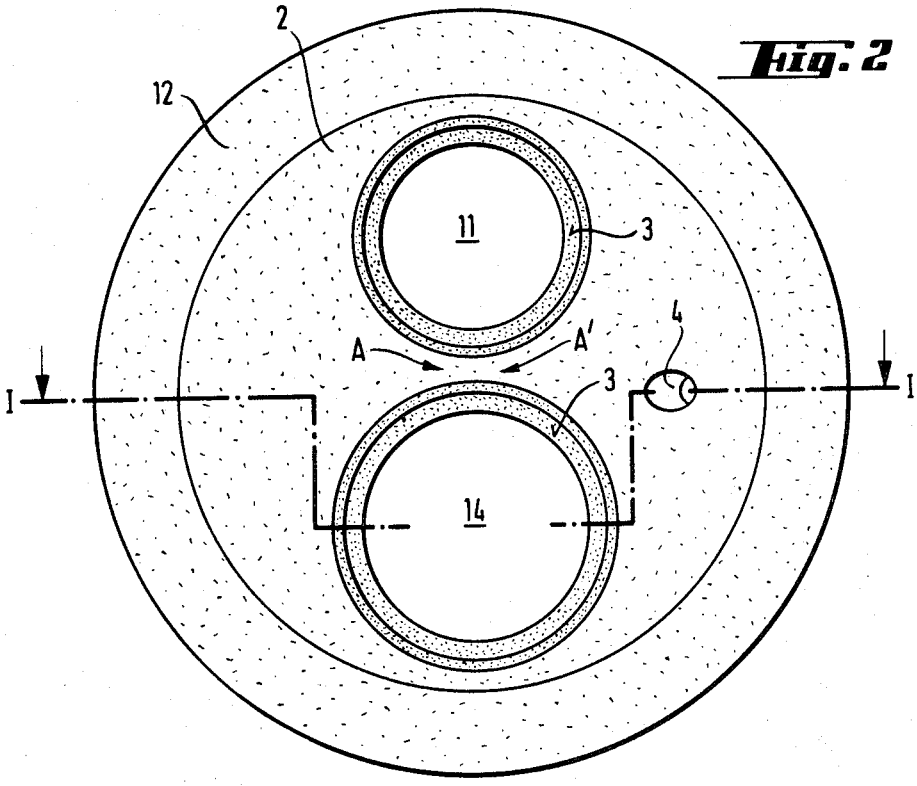
FIG. 2 is a bottom view of the circular plate of aluminum titanate shown in FIG. 1 as the thermal insulation component, which is shrink-fitted into a circular ring of partially stabilized zirconium oxide.

In FIG. 2, the circular plate 2 of aluminum titanate shown in FIG. 1, which is shrink-fitted into a circular ring 12 of partially stabilized zirconium oxide, is represented in a bottom view. In the circular plate 2 of aluminum titanate, the bores 11 and 14 serve for the insertion of the seats 3 for intake and exhaust valves. Valve seats 3 of partially stabilized zirconium oxide are let into the bores 11 and 14. Bore 4 serves, as stated above, for the insertion of an injection nozzle. Arrows A and A' indicate the zone of the circular plate which normally is especially endangered by thermally induced tensions, but in which, in accordance with the present invention, the thermally induced tension is outside of the critical zone.

A preferred embodiment (not shown in the above-described figures) consists in constructing valve seats with a height which is greater than the thickness of the circular plate, so that the valve seats can be shrink-fitted into corresponding recesses in the cylinder head.

It will be understood that the specification and examples are illustrative but not limitative of the present invention and that other embodiments within the spirit and scope of the invention will suggest themselves to those skilled in the art.

What is claimed is:

1. In a cylinder head of a piston engine having a thermal insulation component for the cylinder head bottom facing the combustion chamber, and including openings therethrough; the improvement comprising the entire cylinder head bottom facing the combustion chamber being covered by said thermal insulation component formed as a single layer and comprising an outer planar support ring of zirconium oxide being secured to the cylinder head bottom; and a plate of aluminum titanate sized to form the greater part of the thermal insulation component and being peripherally gripped by said outer zirconium oxide ring.

2. The cylinder head of claim 1 wherein the zirconium oxide ring is in the form of a circular ring with a central opening and the circular plate of aluminum titanate is gripped in said central opening, both said ring and plate being substantially of the same thickness and assembled to be substantially flush with one another.

3. The cylinder head of claim 1 wherein said openings are formed through the aluminum titanate plate.

4. The cylinder head of claim 1 wherein said aluminum titanate plate is shrink fitted into said zirconium oxide ring.

5. The cylinder head of any of claim 1 characterized in that the ultimate flexural strength of the partially stabilized zirconium oxide amounts to at least 400 MPa.

6. The cylinder head of claim 5 wherein said openings are formed through the aluminum titanate plate.

7. The cylinder head of claim 6 wherein said aluminum titanate plate is shrink fitted into said zirconium oxide ring.

8. The cylinder head of claim 1 wherein said support ring is a planar circular ring of zirconium oxide and said plate of aluminum titanate is a planar circular plate.

9. The cylinder head of claim 8, wherein the planar circular ring consists of partially stabilized zirconium oxide.

10. The cylinder head of claim 9 wherein the partially stabilized zirconium oxide has a porosity of less than 3%.

11. The cylinder head of any of claim 9 wherein the partially stabilized zirconium oxide has a content of the cubic modification not exceeding 80 wt.-%, a content of tetragonal modification between 20 and 60 wt.-%, and a content of monoclinic modification not greater than 6 wt.-%, the contents of the individual modifications making up the total of 100 wt.-%.

12. A thermal insulation component for covering the portion of a cylinder head of a piston engine, which faces the combustion chamber, and includes openings therethrough said thermal insulation component being sized to substantially cover the entire cylinder head bottom and comprising a planar support plate of zirconium oxide being secured to the cylinder head bottom; and a plate of aluminum titanate sized to form the greater part of the thermal insulation component and being peripherally gripped by said zirconium oxide plate; wherein the zirconium oxide plate is in the form of a circular ring having a central opening and the circular plate of aluminum titanate is gripped in said central opening, both said plates being substantially of the same thickness and assembled to be substantially flush with one another.

* * * * *